US011873618B1

(12) United States Patent
Lewandowski

(10) Patent No.: US 11,873,618 B1
(45) Date of Patent: Jan. 16, 2024

(54) METHOD OF MODIFYING A BUCKET OF A TRACK LOADER AND FORMING DITCHES WITH THE MODIFIED TRACK LOADER AND APPARATUS THEREWITH

(71) Applicant: Eugene T. Lewandowski, Mt. Pleasant, PA (US)

(72) Inventor: Eugene T. Lewandowski, Mt. Pleasant, PA (US)

( * ) Notice: Subject to any disclaimer, the term of this patent is extended or adjusted under 35 U.S.C. 154(b) by 334 days.

(21) Appl. No.: 17/220,272

(22) Filed: Apr. 1, 2021

(51) Int. Cl.
*E02F 5/02* (2006.01)
*E02F 3/42* (2006.01)
*E02F 3/815* (2006.01)
*E02F 3/96* (2006.01)

(52) U.S. Cl.
CPC ..... *E02F 5/025* (2013.01); *E02F 3/427* (2013.01); *E02F 3/8155* (2013.01); *E02F 3/962* (2013.01); *E02F 5/02* (2013.01)

(58) Field of Classification Search
CPC . E02F 3/8155; E02F 3/427; E02F 5/02; E02F 5/022; E02F 5/025; E02F 5/027; E02F 5/14
See application file for complete search history.

(56) References Cited

U.S. PATENT DOCUMENTS 721,230 A * 2/1903 Smith ..... E02F 5/027 37/367
RE16,200 E * 11/1925 Adams et al. ..... E02F 5/022 172/782
2,863,233 A * 12/1958 Johnson ..... E02F 5/022 414/724
2,948,973 A * 8/1960 Magouirk ..... E02F 5/02 172/815
3,305,952 A * 2/1967 Dressler ..... E01H 8/00 37/207
3,970,818 A 7/1976 Friedrichs
3,985,247 A 10/1976 Stedman
4,043,061 A * 8/1977 Heitman ..... E02F 5/025 37/448
4,068,726 A * 1/1978 Heitman ..... E02F 3/815 172/815
4,077,139 A * 3/1978 Fagervold ..... E01H 5/067 37/280
4,189,854 A * 2/1980 Haynes ..... E02F 3/962 414/724
4,411,081 A * 10/1983 King ..... E02F 5/223 404/121
4,691,455 A * 9/1987 Newman ..... E02F 3/40 37/364
4,704,811 A * 11/1987 Jefferson ..... E02F 3/962 37/364

(Continued)

FOREIGN PATENT DOCUMENTS

WO PCT/SE2016/050250 A1 9/2017
WO WO 2017/164785 A1 9/2017

*Primary Examiner* — Jamie L McGowan

(57) ABSTRACT

Trench digging and carrying with the same bucket attachment present on one track vehicle, the created dual functionality saves both time and expense by doing on-site what would normally be required to be done with two separate vehicles and additional manpower. The bucket attachment is especially advantageous when used in areas with limited space. Another advantage is that the modification can be adapted to bucket vehicles of various sizes.

2 Claims, 4 Drawing Sheets

(56) References Cited

U.S. PATENT DOCUMENTS 4,741,116 A * 5/1988 Engle ..... E01H 5/065 37/280
D299,723 S * 2/1989 Frawley ..... D15/32
5,027,906 A * 7/1991 Jeannotte ..... A01B 43/00 37/903
5,212,897 A * 5/1993 Jefferson ..... E02F 3/962 37/379
5,377,766 A * 1/1995 Klinger ..... E02F 3/962 172/382
5,599,158 A 2/1997 Ajilore
5,692,875 A * 12/1997 Boman ..... E02F 3/404 37/903
5,794,370 A * 8/1998 Haagenstad ..... E02F 3/96 37/903
5,833,008 A * 11/1998 Reed ..... A01G 23/062 37/367
5,901,479 A * 5/1999 Langdon ..... E02F 3/40 37/444
6,067,733 A * 5/2000 Gasper ..... E02F 3/40 37/444
6,085,447 A * 7/2000 Rose ..... E02F 9/2808 37/903
6,240,660 B1 * 6/2001 Dugas ..... E01H 5/066 37/280
6,523,620 B1 * 2/2003 Burson ..... E01H 5/066 172/815
6,701,630 B2 * 3/2004 Humphrey ..... E02F 3/401 37/468
6,742,619 B2 6/2004 Farbotnik et al.
6,928,758 B1 * 8/2005 Stout ..... E02F 3/962 37/444
6,969,226 B2 * 11/2005 Raley ..... E04G 21/0481 37/903
6,994,511 B2 2/2006 Westendorf et al.
7,051,819 B1 * 5/2006 Schenk ..... E01H 1/003 172/784
7,562,727 B1 7/2009 Hoffart
7,798,260 B2 9/2010 Albright et al.
9,015,970 B1 * 4/2015 Doucette ..... E02F 3/404 37/444
9,845,590 B2 12/2017 Spielman
10,287,747 B1 * 5/2019 Jones ..... E02F 5/025
10,544,561 B2 * 1/2020 Desai ..... E02F 3/404
10,697,153 B2 6/2020 Sherlock
10,815,642 B2 10/2020 Ohlsson et al.
11,001,984 B2 * 5/2021 Pratt ..... E02F 3/3627
11,261,579 B1 * 3/2022 Willis ..... E02F 5/025
2004/0010948 A1 * 1/2004 Humphrey ..... E02F 3/962 37/403
2004/0140110 A1 * 7/2004 Raup ..... E02F 3/7609 172/817
2005/0079014 A1 * 4/2005 Panozzo ..... E02F 3/7613 404/72
2006/0266479 A1 11/2006 Stenner
2010/0044062 A1 * 2/2010 Challen ..... E02F 3/7668 172/138
2011/0280359 A1 11/2011 Trice
2011/0311309 A1 * 12/2011 Hartwich ..... E02F 5/22 404/86
2012/0145471 A1 6/2012 Tan et al.
2012/0186112 A1 * 7/2012 Tulibaski ..... E02F 3/404 37/195
2013/0062082 A1 * 3/2013 Layton ..... E01C 23/082 172/445.1
2017/0362783 A1 * 12/2017 Haroldsen ..... E01C 23/088
2019/0008322 A1 1/2019 Feldman et al.
2019/0292750 A1 9/2019 Franck
2023/0047650 A1 * 2/2023 Hefner ..... E02F 3/4075

* cited by examiner

METHOD OF MODIFYING A BUCKET OF A TRACK LOADER AND FORMING DITCHES WITH THE MODIFIED TRACK LOADER AND APPARATUS THEREWITH

BACKGROUND

1. Technical Field

The present application relates to a bucket attachment for track vehicles used in agriculture and construction, which allows for a portion of the bucket to rotate downwards to be used for digging trenches or ditches.

2. Background Information

Background information is for informational purposes only and does not necessarily admit that subsequently mentioned information and publications are prior art.

The present application relates to a bucket attachment which has consists of two partitions, one of which can be rotated at an angle by means of a hydraulic cylinder to angle it in such a way that it can be used to create a ditch or trench.

Ditches and trenches are commonly used in agriculture and construction to create channels for water runoff or irrigation. Ditches or trenches are typically created with specialty equipment, known as a "trenchers." which are made for the sole purpose of digging trenches, or by using a less specialized piece of equipment for moving earth, such as an excavator, which does not require the purchase of less specialized equipment but is more time-consuming and less effective.

Bucket attachments on track vehicles are considered very common and typically used for moving large quantities of earth or debris.

In at least one possible embodiment of the application, the modification of the bucket design allows for the bucket of the track loader to be used for digging trenches without additional specialized equipment while still being capable as function as a standard bucket would.

Object or Objects

An object of the present application is to provide the additional functionality of trench digging while maintaining the normal function of a bucket attachment for a track vehicle.

BRIEF DESCRIPTION OF THE DRAWINGS

Additional embodiments and characteristics of the present application are described in greater detail below with reference to the accompanying pictures, in which.

DESCRIPTION OF EMBODIMENT OR EMBODIMENTS

Figure 1:
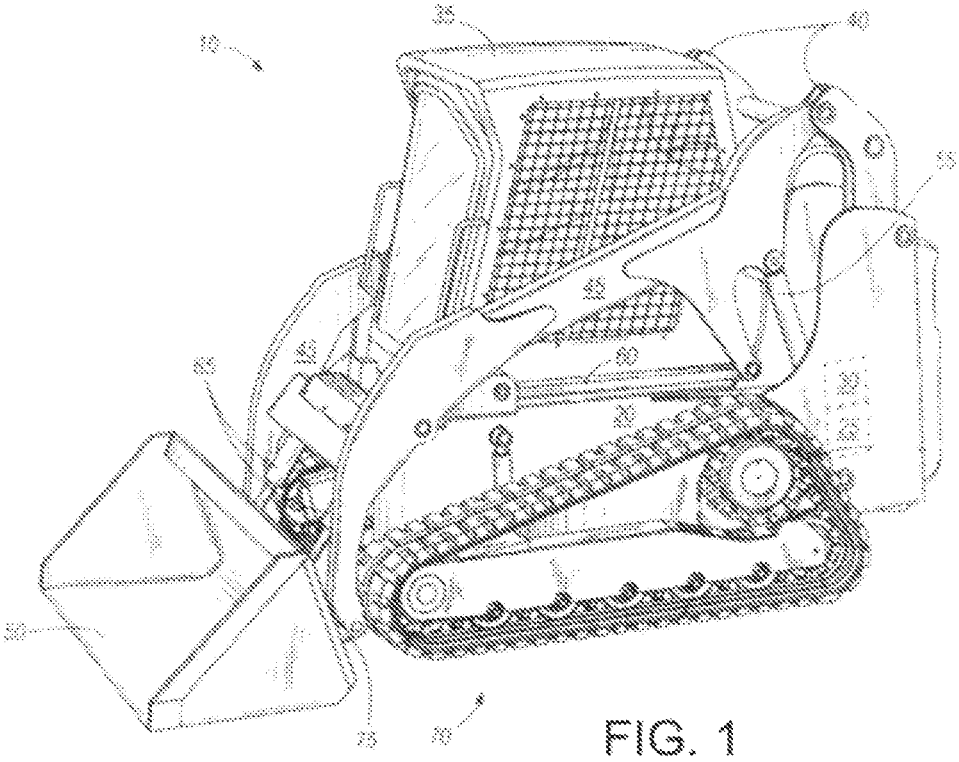
FIG. 1 is a diagram of a track loader.

FIG. 1 is a diagram of a track loader vehicle 10. Although FIGS. 4 through 8 represent one possible arrangement of the present application on a track loader vehicle, it may also be embodied on other track vehicles, such as the skid steer vehicle illustrated in FIG. 2. The compact track loader includes a body frame 20, a hydraulic system 25, an engine 30, a cab 35, a pair of support arms or masts 40, a pair of attachment actuators 65, and a pair of track carriages or assemblies 70 (one on each of the opposite sides of the compact tract loader 10).

The engine drives one or more hydraulic pumps within the hydraulic system 25, and the pumps provide a flow of hydraulic fluid to the lift actuators 56, 65 and hydraulic drive systems to operate the track assemblies 70. The operator controls the hydraulic drive system 25, and therefore operates the compact track loader 10, with controls in the cab 35. In some embodiments, the controls move spool valves (not shown) to direct the hydraulic fluid to the lift actuators 55 and the attachment actuators 65. The support arms 40 are pivotably mounted to the body frame 20, the lift arms are pivotably mounted to the support arms 40, and an attachment interface is 75 is pivotally mounted to the lift arms 45. The lift actuators 65 are interconnected between the lift arms 45 and the body frame 20 and extend and retract in response to the operator's control of the hydraulic system 25 to cause the lift arms 45 to pivot in raising and lowering directions with respect to the support arms 40 and body frame 20. The support links 60 provide additional support and stability to the lift arms 45.

The attachment actuators 85 are interconnected between the lift arms 45 and the attachment interface 75, and extend and retract in response to the operator's control of the hydraulic system 25 to pivot the bucket 50 in curling and dumping directions with respect to the lift arms 45. Although the illustrated attachment is a bucket 50, the compact track loader may in other embodiments include attachments, including without limitation, augers, jack hammers, trenchers, grapples, rotary sweepers, saws, mixers, chippers, and backhoes. Other attachment actuators 65 may be used to raise, lower, tilt, or pivot the attachments for their intended purposes.

FIGS. 4 through 8 illustrate one present application, which is the bucket 50 of a compact track loader vehicle of which a portion of the left-most side 105 has been detached with a vertical cut and re-affixed with a hinge 110 in such a way that it allows the right-most portion of the bucket to rotate downwards. Although the tract pictured in FIGS. 4 through 8 illustrates the right-most side of the bucket being detachable, this modification may be added to the left, right, or both sides of the bucket. Additionally, anywhere from 10-40% of the bucket may be detached.

The hinge which connects the pieces of the bucket comprising of alternating knuckles which have been welded on to the edge of the floor of the bucket where the two pieces meet. A portion of the floor of the detached portion of the bucket has been removed so that the pieces can attach seamlessly, without adding any additional width to the bucket. The pin of the hinge is inserted through the knuckles to join the two pieces of the bucket, with the top of the pin slightly extruding from the edge of the floor of the bucket. A hydraulic cylinder 115 is attached to the back of the bucket, with the piston rod affixed to the detached portion of the bucket 106 and the body of the hydraulic cylinder attached to the intact portion of the bucket 100 in such a way that, when the piston rod of the hydraulic cylinder 115 extends, the detached portion of the bucket 105 rotates downwards at an angle for the purposes of digging a ditch, as seen in FIGS. 4 through 8. When the piston rod of the hydraulic cylinder 115 is not extended, the detached portion of the bucket 105 remains flush with the in-tact portion of the bucket 100, allowing the bucket to function as a conventional bucket would, as seen in FIG. 1.

Figure 4:
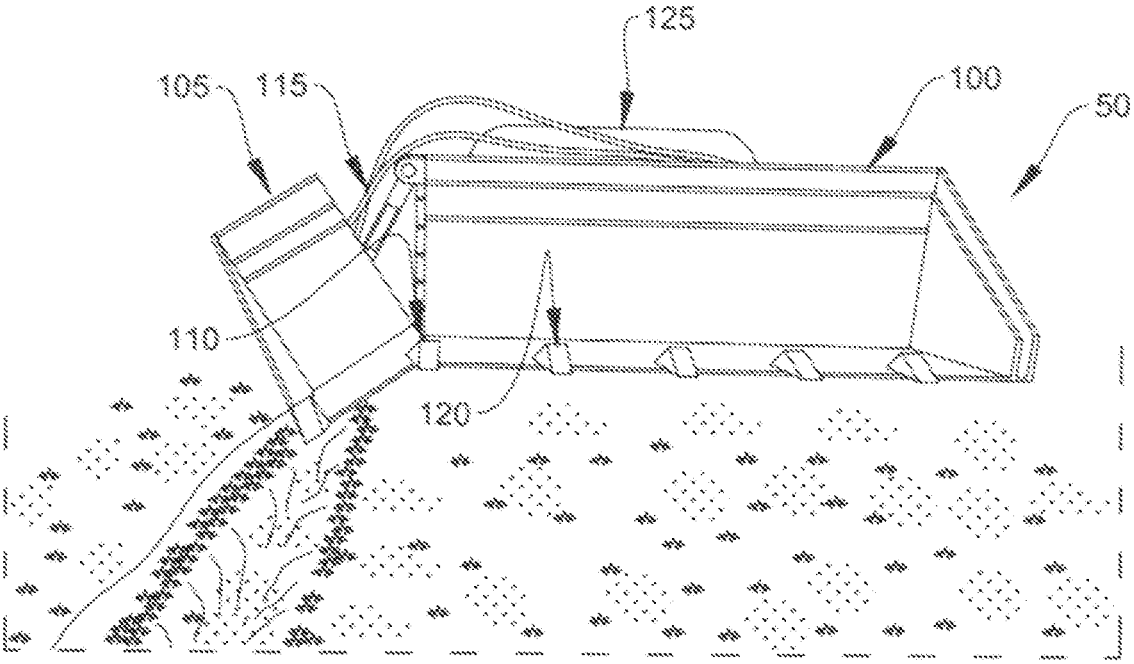
FIG. 4 is the frontal view of an embodiment attached to a track loader being used to dig a trench.

FIG. 4 shows the front view of one possible use of the present invention attached to a track loader vehicle and the trench that it dug. The bucket of the track loader is comprised of two partitions, a detached partition 105 and a fixed partition 100. The detached partition of the bucket 105 in this particular drawing is 18 inches long and secured to the fixed partition by means of a steel hinge 110. The fixed partition Z2 in this particular drawing is 66 inches wide. A hydraulic cylinder 115 is attached to the detached and fixed partition. Although the invention pictured has the mobile partition on the leftmost side of the bucket, this modification may be added to the left, right, or both sides of the bucket. Additionally, the mobile partition may be anywhere from 10-40% of the entire length of the bucket.

Figure 5:
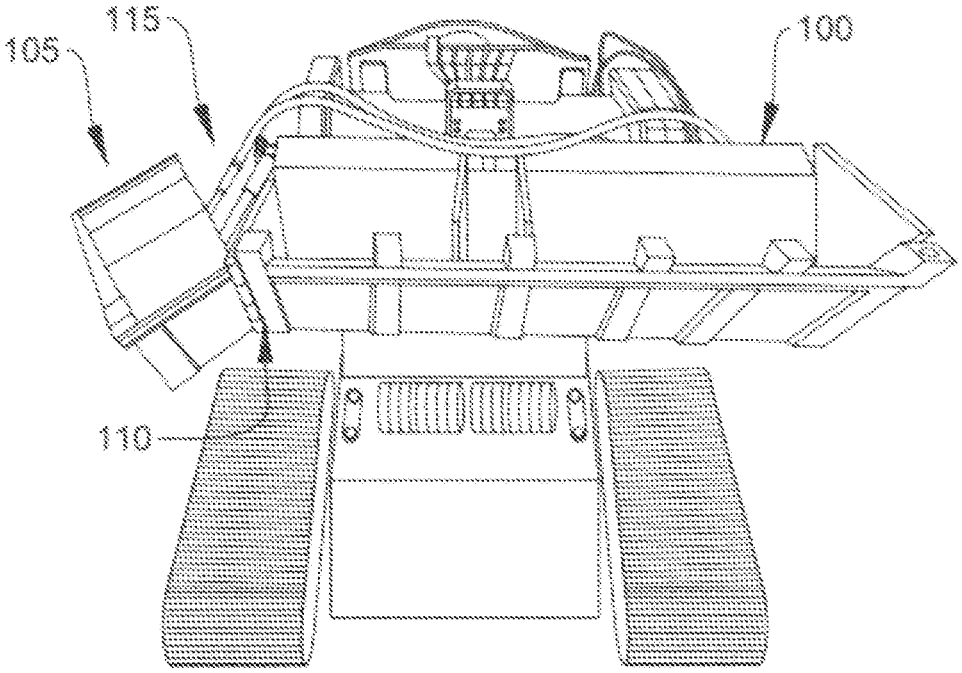
FIG. 5 shows a frontal view with the bucket raised.

FIG. 5 shows the bucket raised.

Figure 6:
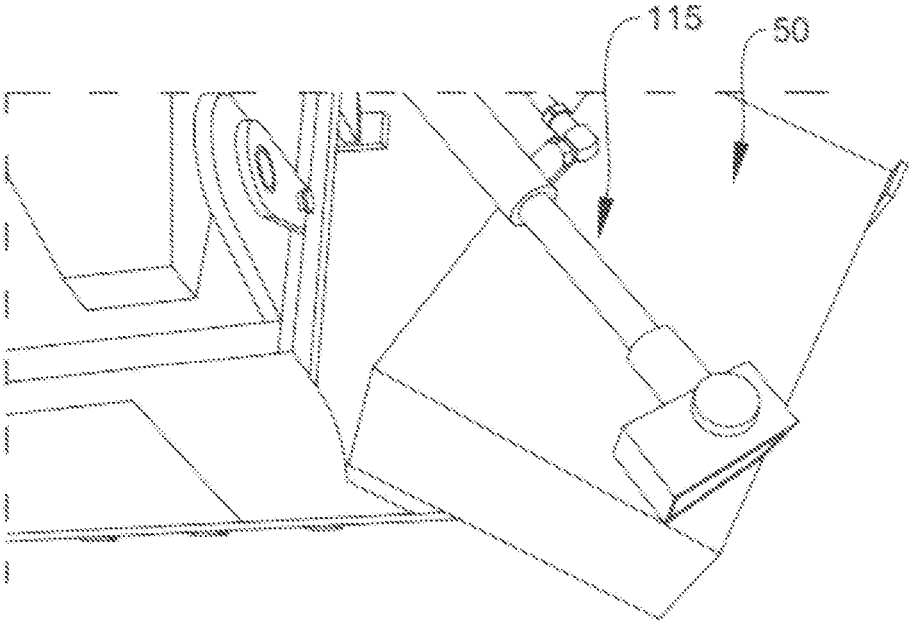
FIG. 6 is the rear view of the attached portion attached to the fixed portion.

FIG. 6 shows the rear view of the same bucket. The hydraulic cylinder 115 is affixed to the top right edge of the stationary partition 125 by means of a bolt through a circular steel fixture welded onto the stationary partition and a bolt through a piece of steel welded onto the bottom right edge of the back of the mobile partition. When the piston rod of the hydraulic cylinder extends, the mobile partition is able to rotate between 0-35 degrees or greater relative to the floor of the stationary partition. The hydraulic cylinder connected to the hydraulic drive system of the track vehicle by at least one or two valves. The hydraulic cylinder could be controlled by a device such as, but not limited to, valve, lever, or button, inside the operator's cabin. The bucket is attached to the attachment interface of the track loader.

Figure 7:
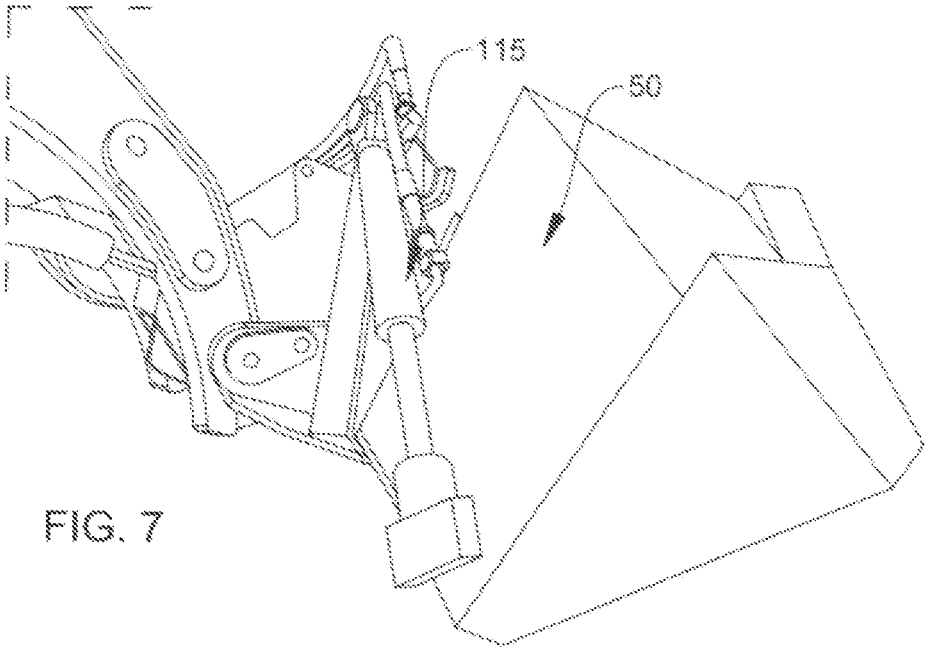
FIG. 7 is the side view of the bucket attached to a vehicle.

FIG. 7 shows the side of the bucket with the detached portion extended maximumly from the fixed portion.

Figure 8:
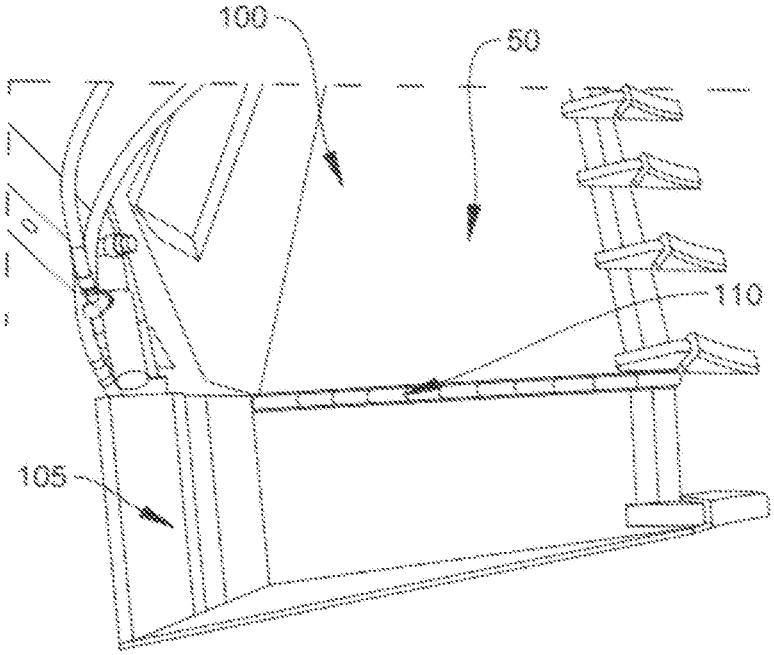
FIG. 8 is a top view of the detached portion fixed to the attached portion.

FIG. 8 shows a top-down view of the embodiment in which the piston rod of the hydraulic cylinder is extended. The hinge 110 keeps the small section 105 attached to the large section 100 of the bucket 50. A portion of the floor of the bucket on the detached partition 100 has been cut out to allow for the knuckles of the hinge 105 to be added without adding extra width to the bucket.

Yet additionally, FIG. 8 illustrates when the hydraulic cylinder 115 is in the closed position, the bucket 50 can be used in ordinary use since the hinge 110 ensures the small section 105 is attached to the large section 100.

Further, FIG. 1 illustrates a compact track loader vehicle 10. Although the invention is illustrated as embodied in a compact track loader 10, it may also be embodied in other track vehicles. The compact track loader 10 includes a body frame 20, a hydraulic system 25, an engine 30, a cab 35, a pair of support arms or masts 40, a pair of lift arms 45, a bucket 50, a pair of lift actuators 55, a pair of support links 60, a pair of attachment actuators 65, and a pair of track carriages or track assemblies 70 (one on each of the opposite sides of the compact tract loader 10).

The engine 30 drives one or more hydraulic pumps within the hydraulic system 25, and the pumps provide a flow of hydraulic fluid to the lift actuators 55, 65 and hydraulic drive systems to operate the track assemblies 70. The operator controls the hydraulic drive system 25, and therefore operates the compact track loader 10, with controls in the cab 35. In some embodiments, the controls move spool valves (not shown) to direct the hydraulic fluid to the lift actuators 55 and the attachment actuators 65. The support arms or masts 40 are pivotably mounted to the body frame 20, the lift arms 45 are pivotably mounted to the support arms 40, and an attachment interface 76 is pivotably mounted to the lift arms 45.

The lift actuators 55 are interconnected between the lift arms 45 and the body frame 20 and extend and retract in response to the operator's control of the hydraulic system 25 to cause the lift arms 45 to pivot in raising and lowering directions with respect to the support arms 40 and body frame 20. The support links 60 provide additional support and stability to the lift arms 45.

The attachment actuators 65 are interconnected between the lift arms 45 and the attachment interface 76, and extend and retract in response to the operator's control of the hydraulic system 25 to pivot the bucket 50 in curling and dumping directions with respect to the lift arms 45. Although the illustrated attachment is a bucket 60, the Compact track loader may in other embodiments include other attachments, including without limitation, augers, jack hammers, trenchers, grapples, rotary sweepers, stump grinders, saws, concrete mixers, pumps, chippers, snow throwers, rotary cutters, and backhoes. With other attachment actuators 65 may be used to raise, lower, tilt, or pivot the attachments for their intended purposes.

Figure 2:
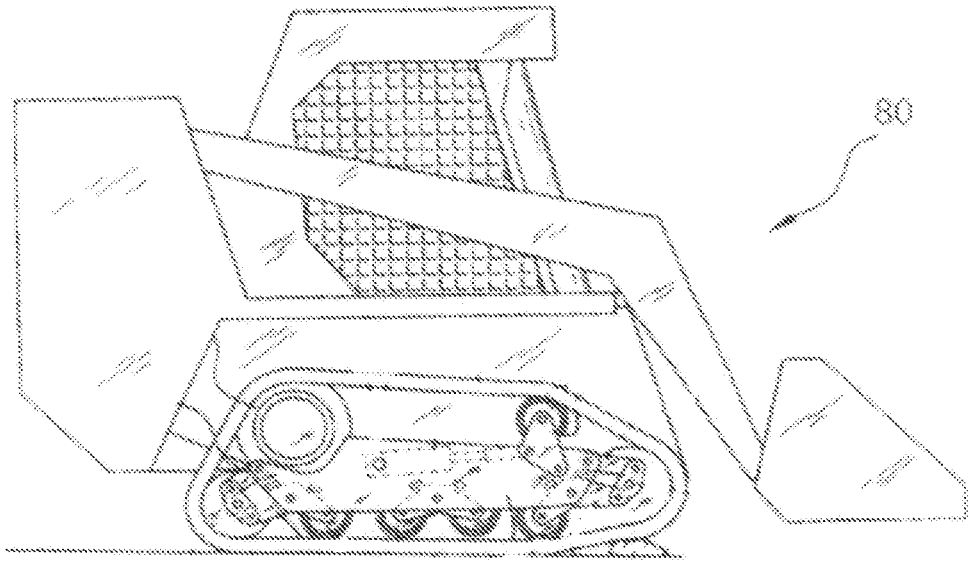
FIG. 2 is a diagram of a skid steer vehicle.

Further, FIG. 2 illustrates a skid steer vehicle 80, wherein the invention may also be embodied within.

Figure 3:
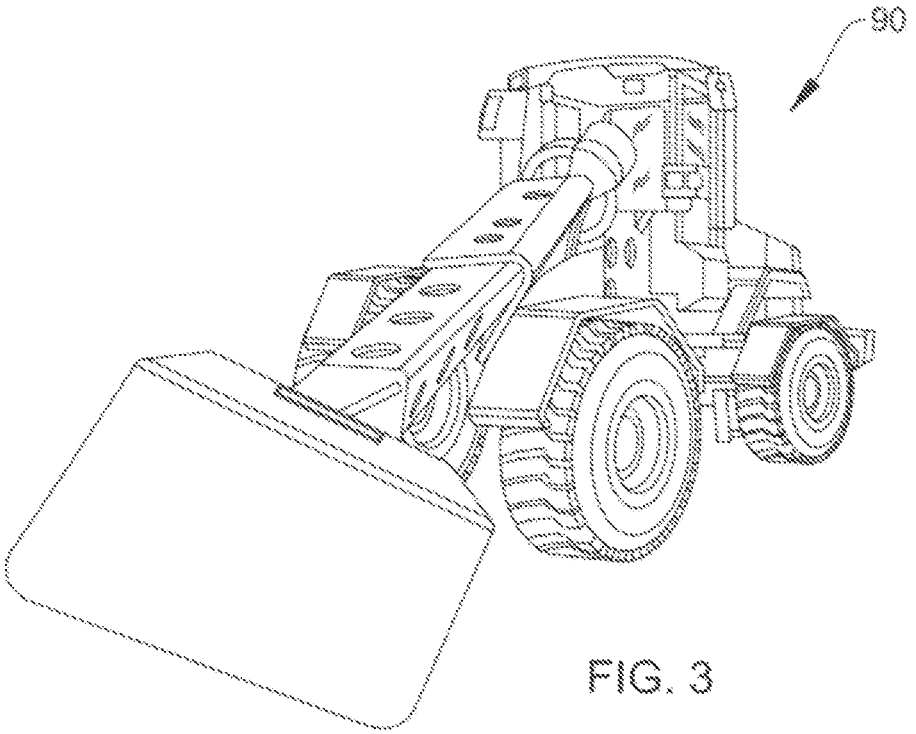
FIG. 3 shows a prior art apparatus for making ditches.

Further, FIG. 3 illustrates a prior art ditch digging machine 90.

Further, FIG. 4 illustrates a bucket 50, according to a first embodiment of the invention. The bucket 50 consists of a large section 100 and a small section 105 connected with a hinge 110 and a hydraulic cylinder 115. The entire bucket 50 extends beyond the track carriages 70 of the track loader vehicle 10. Along the front edge of the bucket 60 are sharp teeth 120 used to cut into the ground. The large section 100 of the bucket 50 includes six sharp teeth 120 while the small section 105 of the bucket 50 only includes one sharp tooth 120. Other embodiments may include more or less teeth along the front edge of the bucket 50. The single sharp tooth 120 of the small section 105 is used to create a ditch by cutting into the ground using only the small section 105 of the bucket 50. The hydraulic cylinder 115 is attached to the track loader vehicle 10 through a series of tubes 125 used to pump hydraulic fluid into and out of the hydraulic cylinder 115 to move the small section 105 of the bucket 50.

Additionally, FIG. 5 illustrates the connection between the small section 105 and the large section 100 of the bucket 50. The hinge 110 keeps the small section 105 attached to the large section 100, while the hydraulic cylinder 115 allows the small section 105 to be separated from the large section 100 in order to dig a ditch. The hydraulic cylinder 115 allows for the small section 105 to be lower about 30 degrees from the large section 100. The hydraulic cylinder 115 and hinge 110 can be adjusted to allow for a smaller or greater angle depending on the depth of ditch desired.

Additionally, FIG. 6 illustrates a back view of the hydraulic cylinder 115 attached to the bucket 50.

Yet further, FIG. 7 illustrates a side view of the hydraulic cylinder 115 attached to the bucket 50.

Yet additionally, FIG. 8 illustrates a front view of the hinge 110 used to keep the small section 105 attached to the large section 100 of the bucket 60. When the hydraulic cylinder 115 is in the closed position, the bucket 50 can be used in ordinary use since the hinge 110 ensures the small section 105 is attached to the large section 100.

A method of modifying a track loader and making a ditch with a modified track loader comprising:

taking a bucket arrangement of a track loader and dividing said bucket into a detached portion and a fixed portion being attached to the track loader, and being configured to be raised and lowered by an operator in the track loader;

attaching said detached portion to said fixed portion by a hinge disposed in the bottom portion of said detached portion and said fixed portion which detached portion is configured to be lowered with respect to said fixed portion;

putting a hydraulic cylinder in a position to move said detached portion with respect to said fixed portion;

cutting said detached portion from a complete bucket for a track loader or independently fabricating said detached portion from metal;

said track loader further comprises:

a body comprising a chassis comprising a forward portion and a rearward portion, which define a longitudinal dimension therebetween, and a first side, and a second side;

an operator's cab mounted to said chassis;

A first driving arrangement disposed at said first side of said chassis;

a second driving arrangement disposed at said second side of said chassis;

an engine mounted to said chassis;

a hydraulic system;

a transmission configured and disposed to drive said first and second driving arrangements in the forward and backward directions;

left and right interconnected lift arm assemblies each comprising:

a lift arm pivotally connected with said body at a lift arm pivot point;

a lift actuator connected between said body and said lift arm, said lift actuator being connected with said lift arm at a fixed second distance from said lift arm pivot point and connected with said body;

a material moving implement pivotally connected with said lift arm assemblies about at least one implement pivot point; and at least one implement tilt actuator connected between at least one of said lift arm assemblies and said material moving implement;

said material moving implement being connected to said bucket arrangement which bucket arrangement is wider than said body and said driving arrangement such that edges of the bucket extending substantially beyond the driving arrangement of the vehicle;

said bucket comprising a longitudinal dimension being disposed transverse to the longitudinal dimension of said track loader;

said bucket further comprising:

a first portion being between approximately 60-95% of the total length of said bucket;

a second portion being the remaining approximate 5-40% of the total length of said bucket; and said fixed portion and said detached portion connected by said hinge such that knuckles of the hinge are substantially flush with a top portion of the bottom of said fixed portion and also a top portion of the bottom of said detached portion of said bucket;

said hydraulic cylinder comprising a body and piston rod and being connected to said hydraulic system;

said hydraulic cylinder mounted to said bucket such that the piston rod is affixed to said fixed portion and the body of the hydraulic cylinder is affixed to said detached portion or vice versa;

said hydraulic cylinder being configured and disposed to rotate said detached portion as much as up to approximately 45 degrees downward relative to said fixed portion, upon said piston rod or said piston body being extended and to thus permit said bucket to be used for the purpose of digging trenches or ditches;

said hydraulic cylinder being further configured and disposed to hold said fixed portion and said detached portion in a position in which they are substantially flush when said piston rod is not extended and to thus permit said bucket to be used for general purpose earthmoving;

a control within said cab to control said piston;

said hydraulic cylinder being further configured to be controlled by an operator operating said track loader within said cab using said control;

said method further comprising;

running said track loader to an area in which a ditch is to be formed;

said operator then:

lowering said detached portion to a desired angle with respect to said fixed portion;

lowering said bucket to an appropriate position in order to be able to form at least a portion of said ditch;

running said track loader sufficiently forward to form at least a portion of said ditch; and continuing running of said track loader forward to complete formation of said ditch.

A modified track loader configured to make a ditch, said modified track loader comprising:

a bucket arrangement of a track loader being divided into a detached portion and a fixed portion;

said bucket arrangement being attached to the track loader and being configured to be raised and lowered by an operator in the track loader;

said detached portion being attached to said fixed portion by a hinge disposed in the bottom portion of said detached portion and said fixed portion which detached portion is configured to be lowered with respect to said fixed portion about said hinge;

a hydraulic cylinder positioned to move said detached portion with respect to said fixed portion;

said track loader further comprising:

a body comprising a chassis comprising a forward portion and a rearward portion, which define a longitudinal dimension therebetween, and a first side, and a second side;

an operator's cab mounted to said chassis;

a first driving arrangement disposed at said first side of said chassis;

a second driving arrangement disposed at said second side of said chassis;

an engine mounted to said chassis;

a hydraulic system;

a transmission configured and disposed to drive said first and second driving arrangements in the forward and backward directions;

left and right interconnected lift arm assemblies each comprising:

a lift arm pivotally connected with said body at a lift arm pivot point;

a lift actuator connected between said body and said lift arm, said lift actuator being connected with said lift arm at a fixed second distance from said lift arm pivot point and connected with said body;

a material moving implement pivotally connected with said lift arm assemblies about at least one implement pivot point; and at least one implement tilt actuator connected between at least one of said lift arm assemblies and said material moving implement;

said material moving implement being connected to said bucket arrangement which bucket arrangement is wider than said body and said driving arrangement such that edges of the bucket extending substantially beyond the driving arrangement of the vehicle;

said bucket comprising a longitudinal dimension being disposed transverse to the longitudinal dimension of said track loader;

said bucket further comprising:

a first portion being between approximately 60-95% of the total length of said bucket;

a second portion being the remaining approximate 5-40% of the total length of said bucket;

said fixed portion and said detached portion connected by said hinge such that knuckles of the hinge are substantially flush with a top portion of the bottom of said fixed portion and also a top portion of the bottom of said detached portion of said bucket;

said hydraulic cylinder comprising a body and piston rod and being connected to said hydraulic system;

said hydraulic cylinder mounted to said bucket such that the piston rod is affixed to said fixed portion and the body of the hydraulic cylinder is affixed to said detached portion or vice versa;

said hydraulic cylinder being configured and disposed to rotate said detached portion as much as up to approximately 45 degrees downward relative to said fixed portion, upon said piston rod or said piston body being extended and to thus permit said bucket to be used for the purpose of digging trenches or ditches;

said hydraulic cylinder being further configured and disposed to hold said first fixed portion and said detached portion in a position in which they are substantially flush when said piston rod is not extended and to thus permit said bucket to be used for general purpose earthmoving or other moving of items;

a control within said cab to control said piston;

said hydraulic cylinder being further configured to be controlled by an operator operating said track loader within said cab using said control;

said track loader being configured to run to an area in which a ditch is to be formed;

said operator then being able to:

lower said detached portion to a desired angle with respect to said fixed portion;

lower said bucket to an appropriate position in order to be able to form at least a portion of said ditch;

run said track loader sufficiently forward to form at least a portion of said ditch; and run said track loader forward to complete formation of said ditch.

The components disclosed in the patents, patent applications, patent publications, and other documents disclosed or incorporated by reference herein, may possibly be used in possible exemplifications of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one exemplification of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various exemplifications may be used with at least one exemplification or all of the exemplifications, if more than one exemplification is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications, patent publications, and other documents cited herein and in the Declaration attached hereto, are hereby incorporated by reference as set forth in in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, patent applications, patent publications, and other documents which are included in this application and which are referred to in paragraphs which state "Some examples of . . . which may possibly be used in at least one possible exemplification of the present application . . . " may possibly not be used or useable in any one or more exemplifications of the application.

The sentence immediately above relates to patents, patent applications, patent publications, and other documents either incorporated by reference or not incorporated ay reference.

The following patents, patent applications, patent publications, and other documents, except for the exceptions indicated herein, are hereby incorporated by reference as if set forth in their entirety herein except for the exceptions indicated herein:

U.S. Pat. No. 3,970,818
U.S. Pat. No. 3,985,247
U.S. Pat. No. 5,599,158
U.S. Pat. No. 6,742,619 B2
U.S. Pat. No. 6,994,511 B2
U.S. Pat. No. 7,562,727
U.S. Pat. No. 7,562,727 B1
U.S. Pat. No. 7,798,260 B2
U.S. Pat. No. 9,845,590 B2
U.S. Pat. No. 10,897,153 B2
U.S. Pat. No. 10,815,642 B2
Patent No.: US 20060266479 (Application)
Patent No.: US 20110280359 (Application)
Patent No.: US 2012/0145471 A1
Patent No.: US 2019/0008322 A1
Patent No.: US 2019/0292750 A1
PCT/SE2016/050250; WO 2017/164785

All of the references and documents cited in any of the patents, patent applications, patent publications, and other documents cited herein, except for the exceptions indicated herein, are hereby incorporated by reference as if set forth in their entirety herein except for the exceptions indicated herein. All of the patents, patent applications, patent publications, and other documents cited herein, referred to in the immediately preceding sentence, include all of the patents, patent applications, patent publications, and other documents cited anywhere in the present application.

Words relating to the opinions and judgments of the author of all patents, patent applications, patent publications, and other documents cited herein and not directly relating to the technical details of the description of the exemplifications therein are not incorporated by reference.

The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more exemplifications of the patents, patent applications, patent publications, and other documents, are not considered to be incorporated by reference herein for any of the patents, patent applications, patent publications, and other documents cited herein.

The description of the exemplification or exemplifications is believed, at the time of the filing of this patent application, to adequately describe the exemplification or exemplifications of this patent application. However, portions of the description of the exemplification or exemplifications may not be completely applicable to the claims as originally filed in this patent application, as amended during prosecution of this patent application, and as ultimately allowed in any patent issuing from this patent application. Therefore, any statements made relating to the exemplification or exemplifications are not intended to limit the claims in any manner and should not be interpreted as limiting the claims in any manner.

The details in the patents, patent applications, patent publications, and other documents cited herein may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the exemplification or exemplifications, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 CFR § 1.72(b). As stated in 37 CFR § 1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made elating to the abstract are not intended to limit the claims in any manner and should not be interpreted as limiting the claims in any manner.

The exemplifications of the invention described herein above in the context of the preferred exemplifications are not to be taken as limiting the exemplifications of the invention to all of the provided details thereof, since modifications and variations thereof may be made without departing from the spirit and scope of the exemplifications of the invention.

What is claimed is:

1. A method of modifying a track loader and making a ditch with a modified track loader comprising:

taking a bucket arrangement of a track loader and dividing said bucket into a detached portion and a fixed portion being attached to the track loader, and being configured to be raised and lowered by an operator in the track loader;

attaching said detached portion to said fixed portion by a hinge disposed in the bottom portion of said detached portion and said fixed portion which detached portion is configured to be lowered with respect to said fixed portion;

putting a hydraulic cylinder in a position to move said detached portion with respect to said fixed portion;

cutting said detached portion from a complete bucket for a track loader or independently fabricating said detached portion from metal;

said track loader further comprises:

a body comprising a chassis comprising a forward portion and a rearward portion, which define a longitudinal dimension therebetween, and a first side, and a second side;

an operator's cab mounted to said chassis;

A first driving arrangement disposed at said first side of said chassis;

a second driving arrangement disposed at said second side of said chassis;

an engine mounted to said chassis;

a hydraulic system;

a transmission configured and disposed to drive said first and second driving arrangements in the forward and backward directions;

left and right interconnected lift arm assemblies each comprising:

a lift arm pivotally connected with said body at a lift arm pivot point;

a lift actuator connected between said body and said lift arm, said lift actuator being connected with said lift arm at a fixed second distance from said lift arm pivot point and connected with said body;

a material moving implement pivotally connected with said lift arm assemblies about at least one implement pivot point; and at least one implement tilt actuator connected between at least one of said lift arm assemblies and said material moving implement;

said material moving implement being connected to said bucket arrangement which bucket arrangement is wider than said body and said driving arrangement such that edges of the bucket extending substantially beyond the driving arrangement of the vehicle;

said bucket comprising a longitudinal dimension being disposed transverse to the longitudinal dimension of said track loader;

said bucket further comprising:

a first portion being between approximately 60-95% of the total length of said bucket;

a second portion being the remaining approximate 5-40% of the total length of said bucket; and said fixed portion and said detached portion connected by said hinge such that knuckles of the hinge are substantially flush with a top portion of the bottom of said fixed portion and also a top portion of the bottom of said detached portion of said bucket;

said hydraulic cylinder comprising a body and piston rod and being connected to said hydraulic system;

said hydraulic cylinder mounted to said bucket such that the piston rod is affixed to said fixed portion and the body of the hydraulic cylinder is affixed to said detached portion or vice versa;

said hydraulic cylinder being configured and disposed to rotate said detached portion as much as up to approximately 45 degrees downward relative to said fixed portion, upon said piston rod or said piston body being extended and to thus permit said bucket to be used for the purpose of digging trenches or ditches;

said hydraulic cylinder being further configured and disposed to hold said fixed portion and said detached portion in a position in which they are substantially flush when said piston rod is not extended and to thus permit said bucket to be used for general purpose earthmoving;

a control within said cab to control said piston;

said hydraulic cylinder being further configured to be controlled by an operator operating said track loader within said cab using said control;

said method further comprising;

running said track loader to an area in which a ditch is to be formed;

said operator then:

lowering said detached portion to a desired angle with respect to said fixed portion;

lowering said bucket to an appropriate position in order to be able to form at least a portion of said ditch;

running said track loader sufficiently forward to form at least a portion of said ditch; and continuing running of said track loader forward to complete formation of said ditch.

2. A modified track loader configured to make a ditch, said modified track loader comprising:

a bucket arrangement of a track loader being divided into a detached portion and a fixed portion;

said bucket arrangement being attached to the track loader and being configured to be raised and lowered by an operator in the track loader;

said detached portion being attached to said fixed portion by a hinge disposed in the bottom portion of said detached portion and said fixed portion which detached portion is configured to be lowered with respect to said fixed portion about said hinge;

a hydraulic cylinder positioned to move said detached portion with respect to said fixed portion;

said track loader further comprising:

a body comprising a chassis comprising a forward portion and a rearward portion, which define a longitudinal dimension therebetween, and a first side, and a second side;

an operator's cab mounted to said chassis;

a first driving arrangement disposed at said first side of said chassis;

a second driving arrangement disposed at said second side of said chassis;

an engine mounted to said chassis;

a hydraulic system;

a transmission configured and disposed to drive said first and second driving arrangements in the forward and backward directions;

left and right interconnected lift arm assemblies each comprising:

a lift arm pivotally connected with said body at a lift arm pivot point;

a lift actuator connected between said body and said lift arm, said lift actuator being connected with said lift arm at a fixed second distance from said lift arm pivot point and connected with said body;

a material moving implement pivotally connected with said lift arm assemblies about at least one implement pivot point; and at least one implement tilt actuator connected between at least one of said lift arm assemblies and said material moving implement;

said material moving implement being connected to said bucket arrangement which bucket arrangement is wider than said body and said driving arrangement such that edges of the bucket extending substantially beyond the driving arrangement of the vehicle;

said bucket comprising a longitudinal dimension being disposed transverse to the longitudinal dimension of said track loader;

said bucket further comprising:

a first portion being between approximately 60-95% of the total length of said bucket;

a second portion being the remaining approximate 5-40% of the total length of said bucket;

said fixed portion and said detached portion connected by said hinge such that knuckles of the hinge are substantially flush with a top portion of the bottom of said fixed portion and also a top portion of the bottom of said detached portion of said bucket;

said hydraulic cylinder comprising a body and piston rod and being connected to said hydraulic system;

said hydraulic cylinder mounted to said bucket such that the piston rod is affixed to said fixed portion and the body of the hydraulic cylinder is affixed to said detached portion or vice versa;

said hydraulic cylinder being configured and disposed to rotate said detached portion as much as up to approximately 45 degrees downward relative to said fixed portion, upon said piston rod or said piston body being extended and to thus permit said bucket to be used for the purpose of digging trenches or ditches;

said hydraulic cylinder being further configured and disposed to hold said fixed portion and said detached portion in a position in which they are substantially flush when said piston rod is not extended and to thus permit said bucket to be used for general purpose earthmoving or other moving of items;

a control within said cab to control said piston;

said hydraulic cylinder being further configured to be controlled by an operator operating said track loader within said cab using said control;

said track loader being configured to run to an area in which a ditch is to be formed;

said operator then being able to:

lower said detached portion to a desired angle with respect to said fixed portion;

lower said bucket to an appropriate position in order to be able to form at least a portion of said ditch;

run said track loader sufficiently forward to form at least a portion of said ditch; and run said track loader forward to complete formation of said ditch.

* * * * *